US007712798B2

(12) United States Patent
Kraus et al.

(10) Patent No.: US 7,712,798 B2
(45) Date of Patent: May 11, 2010

(54) LOCKING HANDLE, IN PARTICULAR FOR A MOTOR VEHICLE

(75) Inventors: Jürgen Kraus, Balve (DE); Ralf Gerndorf, Finnentrop (DE)

(73) Assignee: Dura Automotive Plettenberg Entwicklungs- und Vertriebs GmbH, Plettenberg (DE)

( * ) Notice: Subject to any disclaimer, the term of this patent is extended or adjusted under 35 U.S.C. 154(b) by 300 days.

(21) Appl. No.: 11/371,336

(22) Filed: Mar. 7, 2006

(65) Prior Publication Data

US 2006/0226659 A1 Oct. 12, 2006

(30) Foreign Application Priority Data

Mar. 11, 2005 (DE) ..... 10 2005 011 388
Sep. 5, 2005 (DE) ..... 10 2005 042 090

(51) Int. Cl.
*E05C 9/10* (2006.01)
*E05C 9/00* (2006.01)

(52) U.S. Cl. ..... 292/37; 292/32; 292/38; 292/42; 292/169; 292/224; 292/DIG. 37; 292/DIG. 46; 49/183

(58) Field of Classification Search ..... 292/32, 292/33, 37, 38, 41, 42, 169, 171, 174, 175, 292/219, 224, 225, 227, 228, DIG. 20, DIG. 37, 292/DIG. 46, DIG. 47; 49/183
See application file for complete search history.

(56) References Cited

U.S. PATENT DOCUMENTS 357,985 A * 2/1887 Frisbie ..... 292/33
417,589 A * 12/1889 Rose ..... 292/40
426,765 A * 4/1890 Brunhoff et al ..... 292/166
714,362 A * 11/1902 Carpenter ..... 160/27
1,180,123 A * 4/1916 Florcken ..... 292/33
1,556,864 A * 10/1925 Mendenhall ..... 292/33
1,671,249 A 5/1928 Lieberman
1,756,880 A * 4/1930 Rand ..... 312/286
4,365,490 A * 12/1982 Manzoni ..... 70/70
4,968,071 A * 11/1990 Stern ..... 292/150
4,968,092 A * 11/1990 Giambrone ..... 297/151
6,000,733 A 12/1999 Linder
6,279,266 B1 * 8/2001 Searcy ..... 49/183

FOREIGN PATENT DOCUMENTS

DE 35317 4/1886
DE 3615720 11/1986

(Continued)

OTHER PUBLICATIONS

European Patent Office, attachment to European Search Report of 06003730.6-1267, May 26, 2008, Europe.

(Continued)

*Primary Examiner*—Carlos Lugo
(74) *Attorney, Agent, or Firm*—Alleman Hall McCoy Russell & Tuttle LLP

(57) ABSTRACT

A locking handle which is in particular provided for a motor vehicle comprises a star handle which is rotatably supported around an axle and to which one or more locking rods are fastened. An improved locking handle of this type comprises a longitudinally displaceably guided slide actuator with an actuator part. An engagement part is provided at the star handle.

17 Claims, 12 Drawing Sheets

FOREIGN PATENT DOCUMENTS

| | | |
|---|---|---|
| DE | 2730407 | 1/1987 |
| DE | 9210980 | 12/1992 |
| EP | 1201851 | 5/2002 |
| EP | 1253267 | 10/2002 |
| FR | 1361753 | 5/1964 |
| FR | 1457497 | 1/1966 |
| GB | 197257 | 5/1923 |

OTHER PUBLICATIONS

European Patent Office, Official Action of 06003730.6-1267, May 26, 2008, Europe.

* cited by examiner

LOCKING HANDLE, IN PARTICULAR FOR A MOTOR VEHICLE

CROSS REFERENCE TO RELATED APPLICATIONS

This application claims priority to German Patent Application Serial No. 10 2005 011 388.5 filed Mar. 11, 2005, and German Patent Application Serial No. 10 2005 042 090.7 filed Sep. 5, 2005, each of which are hereby incorporated by reference in their entirety for all purposes.

FIELD

The present disclosure relates to a locking handle, in particular for a vehicle. The locking handle is suitable for vehicles of all types, that is for land vehicles, water vehicles, aeronautical vehicles, etc. It is in particular suitable for a motor vehicle. The locking handle is particularly suitable for a moving window, in particular for a sliding window, of a vehicle or of a motor vehicle.

BACKGROUND AND SUMMARY

A locking handle for a vehicle is disclosed in EP 1 253 267 A1. The locking handle comprises a star handle, referred to therein as a disk, which is rotatably supported around an axle and to which two locking rods, referred to as drive rods, can be fastened or are fastened. The star handle is driven by a rocker actuator whose axis of rotation extends substantially at a right angle to the axis of rotation of the star handle.

The present disclosure provides an improved locking handle for a vehicle, comprising a longitudinally displaceably guided slide actuator which has an actuator part. The star handle is provided with an engagement part. The actuator part and the engagement part cooperate with one another such that a movement of the actuator part can be transmitted to the engagement part. The star handle is rotated by the movement of the actuator part transmitted to the engagement part. It can be sufficient for this purpose for the actuator part to be in active connection to the slide actuator and/or for the engagement part to be in active connection to the star handle.

Additionally, a compression spring may be supported at the slide actuator. A bias of the slide actuator is hereby produced which is preferably outwardly directed.

Additionally, the slide actuator may be covered by a panel.

It may be advantageous for two locking rods to be able to be secured or to be secured to the star handle. The locking rods can preferably be secured or are secured to oppositely disposed sides of the axle of the star handle. They preferably face in opposite directions. A movement of the locking rods in the opposite sense can be produced by the arrangement described.

It may be advantageous in specific cases to provide a further slide actuator. The slide actuator and the further slide actuator are preferably longitudinally displaceably guided in opposite directions. A compression spring supported at both slide actuators is preferably present.

Another advantageous further development is characterized in that a further star handle is provided. The further star handle can be rotatably supported around the same axle as the star handle. It is, however, also possible for the further star handle to be rotatably supported around a further axle which is spaced apart from the axle for the star handle.

The present disclosure further relates to a moving window, in particular to a sliding window, for a vehicle, in particular for a motor vehicle. In accordance with the present disclosure, this moving window or sliding window is characterized by one or more locking handles in accordance with the present disclosure.

It may be advantageous for the locking handle to be actuable in the direction of the displacement of the sliding window. The locking handle is preferably installed in the sliding window or connected to the sliding window such that it is actuable in the same direction in which the sliding window is also displaceable. If the sliding window extends in a vertical plane and is displaceable in the horizontal longitudinal direction of the vehicle, the locking handle is preferably provided at a vertically extending frame part of the sliding window, and indeed such that the slide actuator is likewise longitudinally displaceably guided in the horizontal longitudinal direction of the vehicle.

The locking handle is preferably provided in a frame part of the sliding window. The frame can completely surround the sliding window. It is, however, also possible for the frame only to partly surround the sliding window. The frame can be present in a rectangular sliding window at, for example, three sides, at two sides or only at one side.

Another advantageous further development is characterized in that the slide actuator of the locking handle is longitudinally displaceably guided in a direction transversely to the longitudinal direction of the frame part.

BRIEF DESCRIPTION OF THE FIGURES

Embodiments of the present disclosure will be explained in detail in the following with reference to the enclosed drawings. There are shown in the drawings.

DETAILED DESCRIPTION

Figure 1:
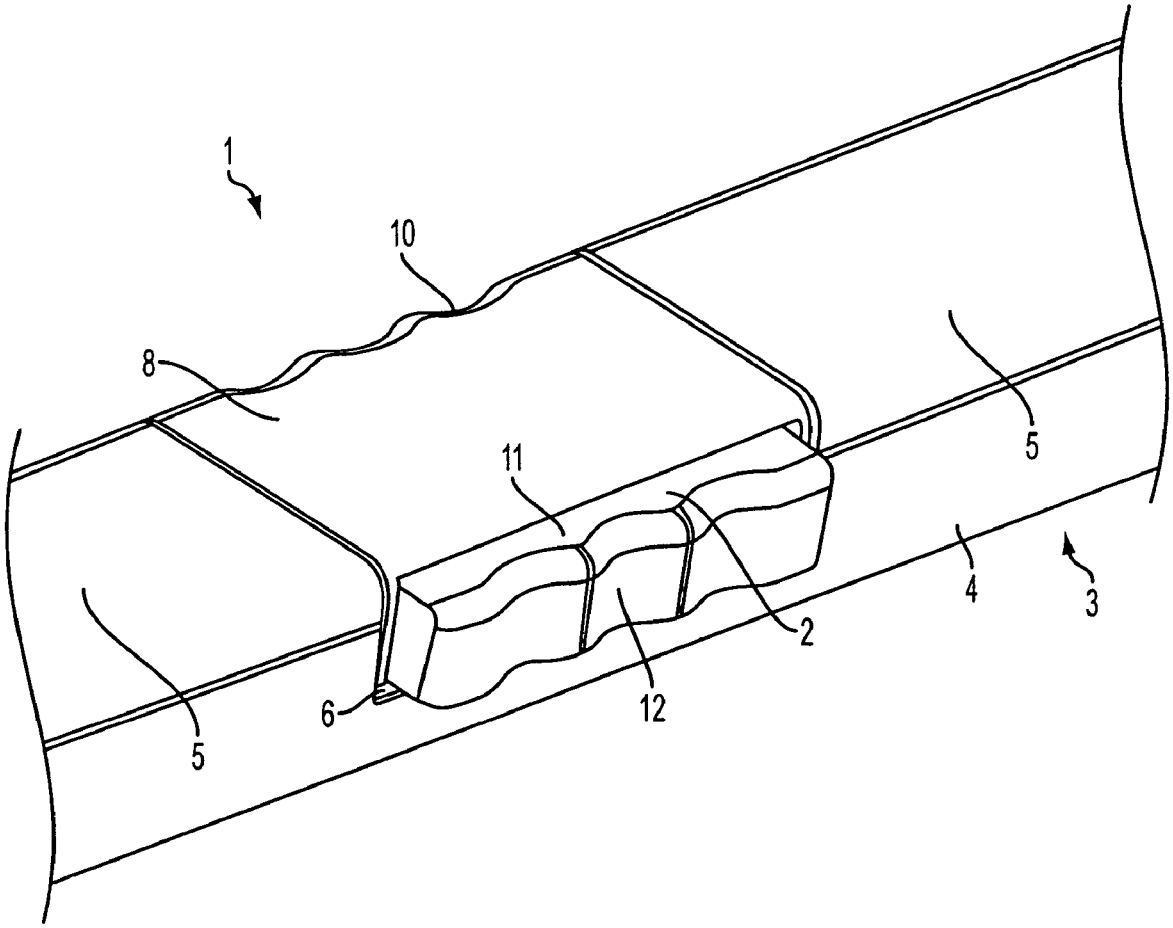
FIG. 1 shows a part of a frame of a sliding window with a locking handle in a perspective view.
Figure 2:
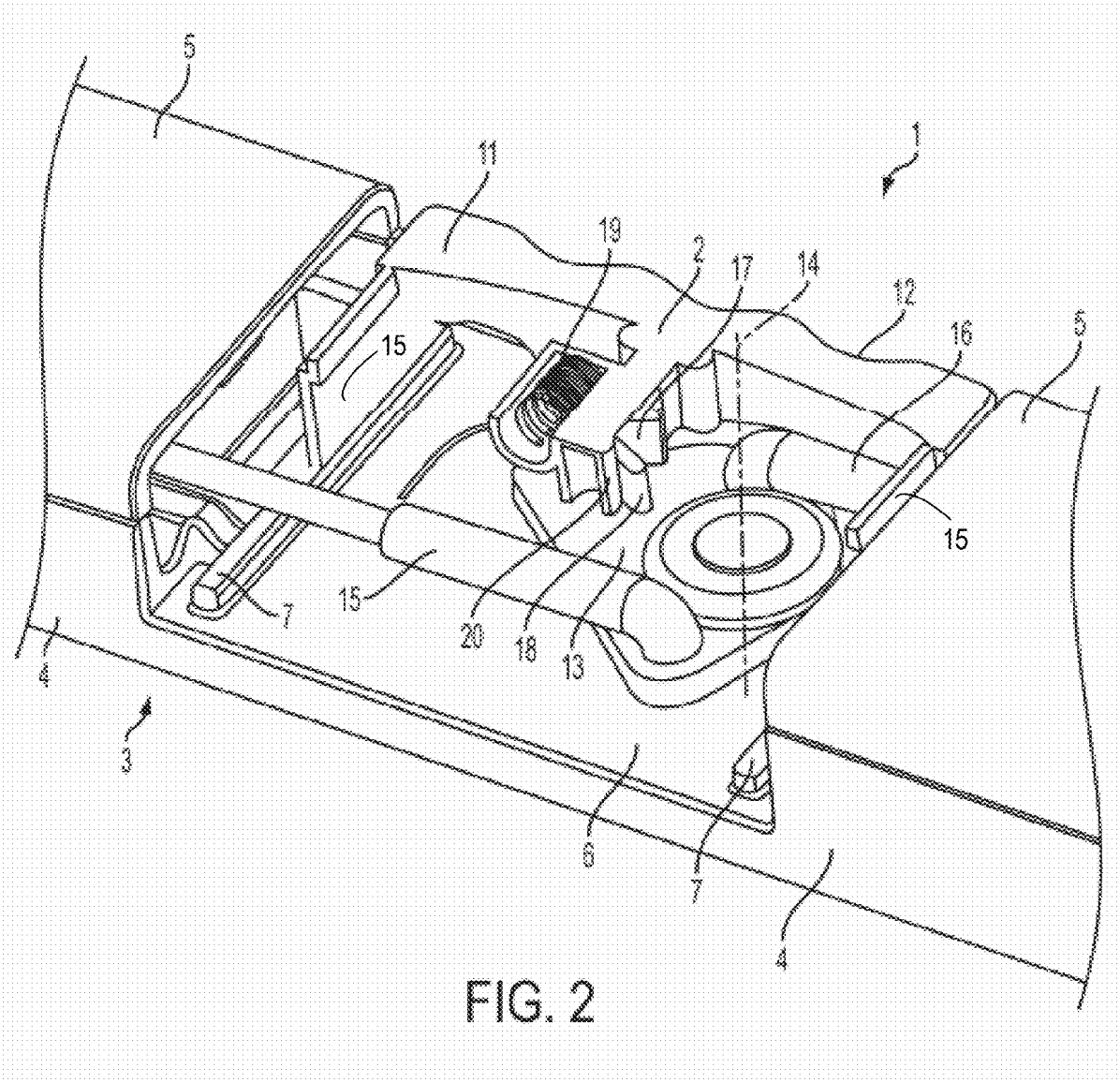
FIG. 2 shows the components of FIG. 1 without the panel of the locking handle.
Figure 3:
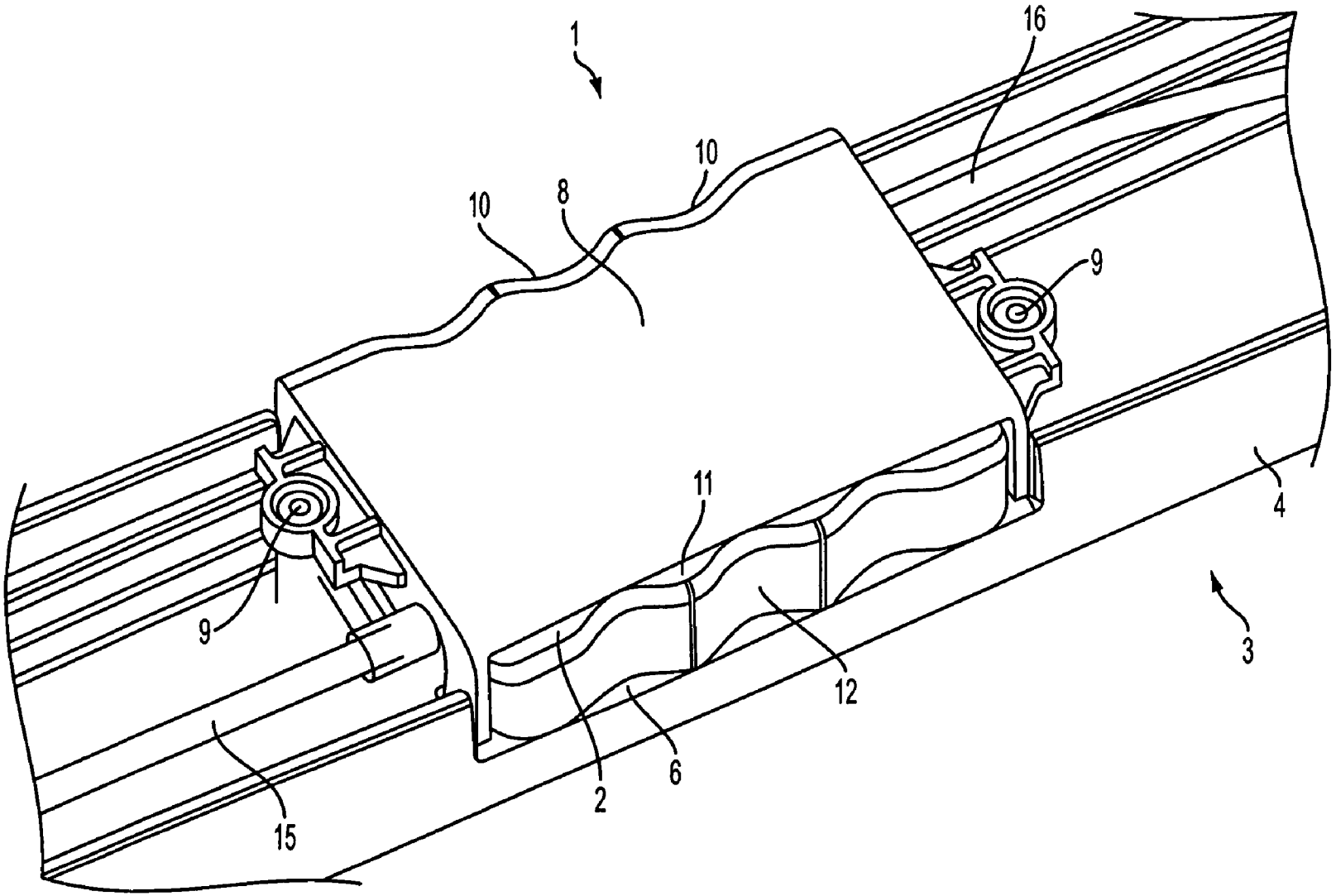
FIG. 3 shows the components of FIG. 1 without the covers of the frame part.

FIGS. 1 to 3 show a first embodiment in which the locking handle 1 has a slide actuator 2. The locking handle 1 is located in a frame part 3 of a sliding window. The frame part 3 comprises a base strip 4 and a cover 5. In the region of the locking handle 1, a cut-out 6 is provided in the base strip 4 of the frame part 3 and two guide rails 7 are located therein which are parallel, spaced apart and extend in a direction transversely to the longitudinal direction of the frame part 3. The slide actuator 2 is guided longitudinally displaceably along these guide rails 7. The slide actuator 2 includes a pair of walls 15 extending perpendicularly to the direction of the sliding movement of the slide actuator 2. The pair of walls 15 extend perpendicularly from a base of the frame part 3 on which the pair of walls 15 of the slide actuator 2 are positioned against in order to allow the slide actuator 2 to be displaceable.

The slide actuator 2 is covered by a panel 8 which is fixedly connected to the frame part 3. For this purpose, the panel 8 has a respective projection with an eye 9 at its ends, with the panel 8 being able to be screwed to the frame part 3 through said eye. The surface of the panel 8 coincides with the adjacent covers 5 of the frame part 3. It has gripping dimples 10 in the region of the cut-out 6. The slide actuator 2 comprises a gripping part 11 having gripping dimples 12 which are disposed opposite to the gripping dimples 10 of the panel 8.

The locking handle furthermore comprises a star handle 13 which is rotatably supported in the cut-out 6 around an axle 14 extending perpendicular to the longitudinal direction of the frame part 3 and perpendicular to the guide rails 7. A first locking rod 15 and a second locking rod 16 are fastened to the star handle 13. The locking rods 15, 16 extend in the longitudinal direction of the frame part 3, and indeed in opposite directions. The fastening positions of the locking rods 15, 16 to the star handle 13 are disposed on opposite sides of the axle 14 of the star handle 13. The locking rods 15, 16 accordingly carry out the movements in opposite senses when the star handle 13 is rotated around the axle 14.

To initiate a rotary movement in the star handle 13, the slide actuator 2 is provided with an actuator part 17 which cooperates with an engagement part 18 provided at the star handle 13. The slide actuator 2 is biased by a compressing spring 19 in an outward direction. For this purpose, the end of the compression spring 19 shown at the top right in FIG. 2 is supported at an abutment of the slide actuator 2. The other end of the compression spring 19 is supported at the frame part 3 (not shown in the drawing).

If the slide actuator 2 is pressed inwardly, the actuator part 17 of the slide actuator 2 presses the engagement part 18 of the star handle 13 contacting it inwardly, whereby a rotary movement of the star handle 13 is produced in a counter clockwise direction around the axle 14. The locking rods 15, 16 are thereby pulled inwardly. The other ends of the locking rods 15, 16 move out of engagement in this manner (not shown in the drawing), whereby the locking of the slide window is released.

When the slide actuator 2 is released, it is pressed outwardly by the force of the compression spring 19. A further actuator part 20, which is provided at the slide actuator 2 and which contacts the engagement part 18 on the side disposed opposite the actuator part 17, presses this engagement part 18 in an outward direction, whereby the star handle 13 is rotated in a clockwise direction around the axle 14. The locking rods 15, 16 each move outwardly in opposite senses until the position shown in FIG. 2 is adopted again in which the sliding window is again locked.

A second embodiment is shown in FIGS. 4 to 8 in which coinciding parts are provided with the same reference numerals and are not explained again. In contrast to the first embodiment, the second embodiment comprises a further slide actuator 21 and a further star handle 22. The star handles 13, 22 are rotatably supported around the same axle 14.

The further slide actuator 21 has a further actuator part 23 which cooperates with a further engagement part 24 provided at the further star handle 22.

Figure 5:
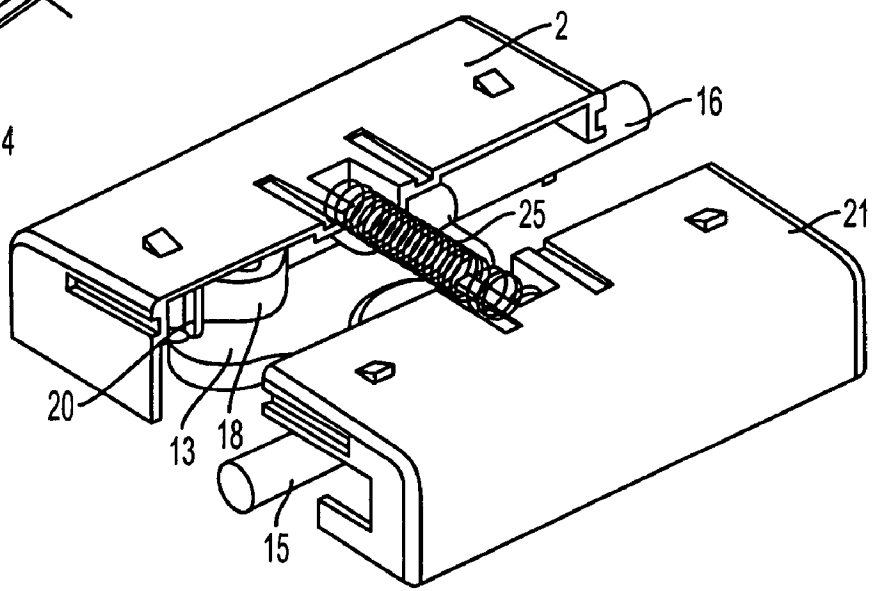
FIG. 5 shows the locking handle of FIG. 4 without a cover.
Figure 4:
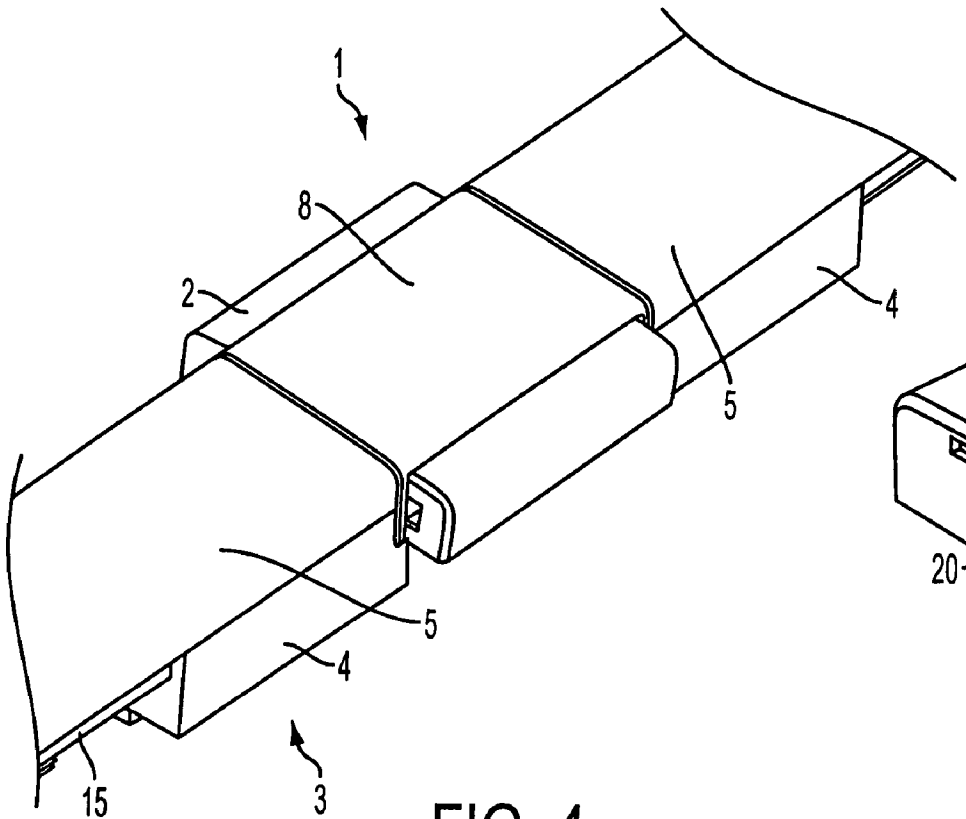
FIG. 4 shows a second embodiment of a locking handle with two slide actuators.
Figure 6:
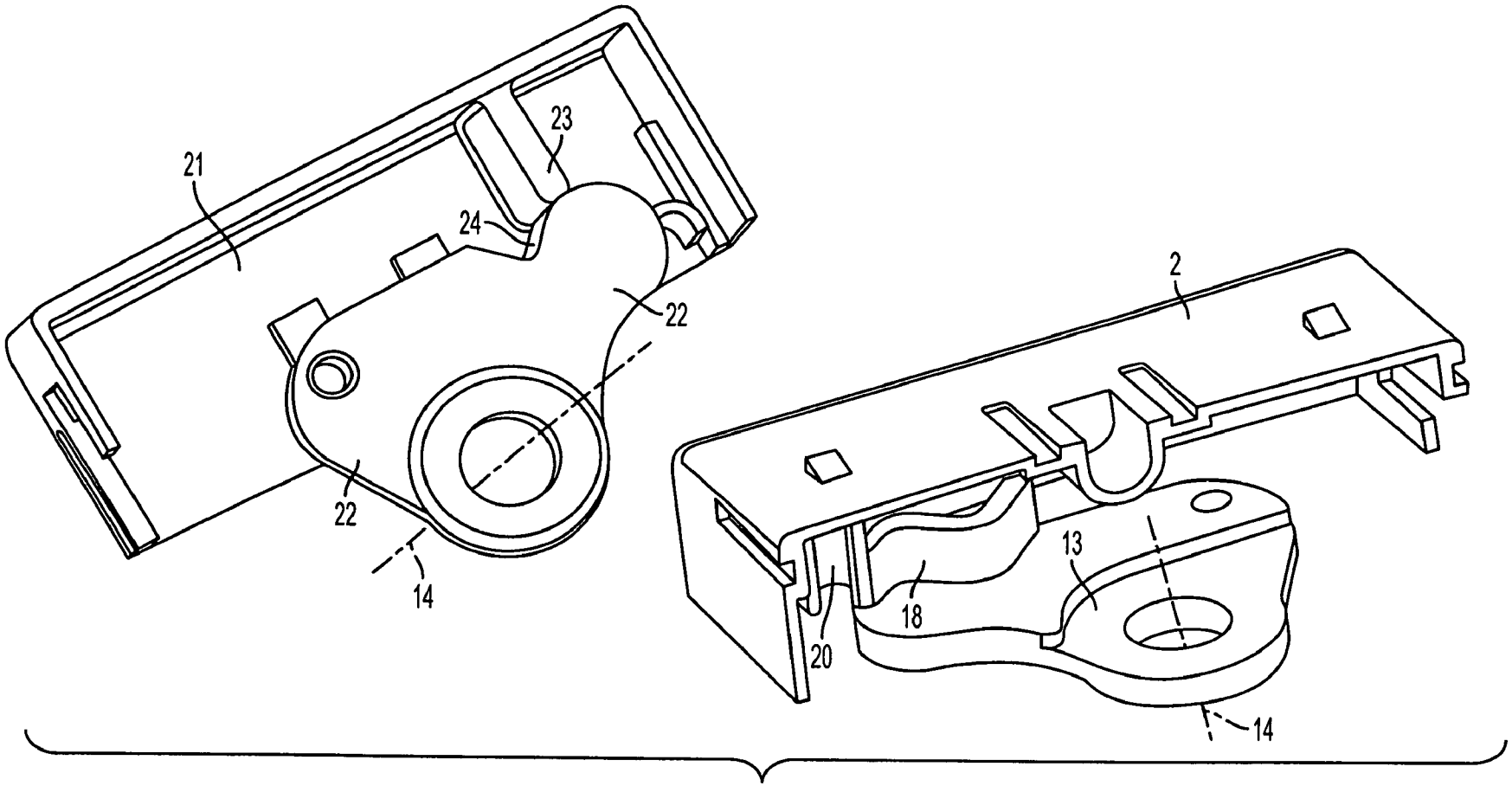
FIG. 6 shows the slide actuator of the locking handle of FIGS. 4 and 5 in a different perspective representation.
Figure 7:
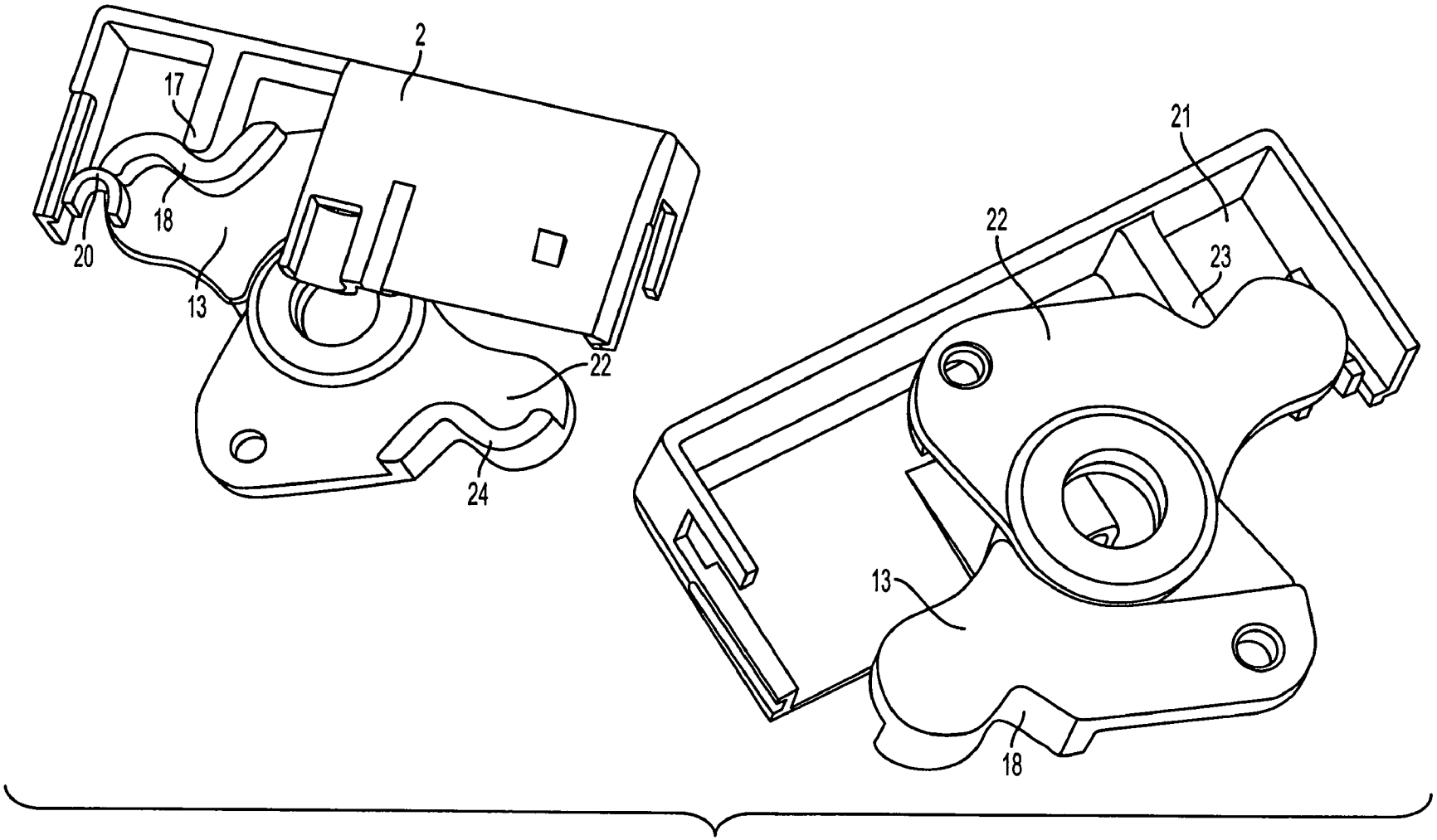
FIG. 7 shows the slide actuator of FIGS. 4 to 6 in a different perspective representation.
Figure 8:
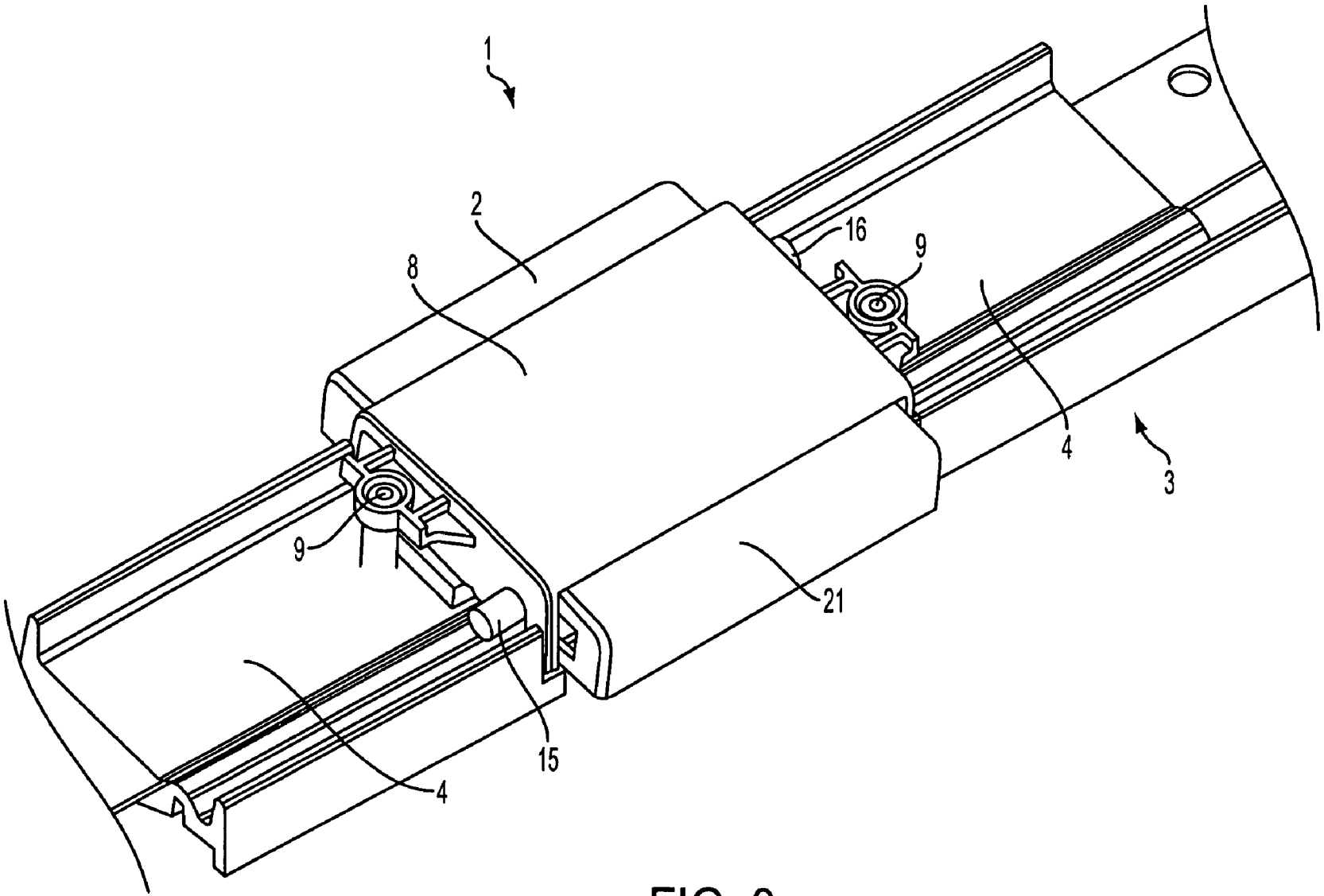
FIG. 8 shows the locking handle of FIGS. 4 to 7 in a representation corresponding to FIG. 4 without the covers of the frame part.

At their upper sides, the slide actuators 2, 21 have semicylindrical recesses which lie opposite one another in the manner visible in particular from FIG. 5 and which serve as abutments for a compression spring 25. The compression spring 25 is supported at both slide actuators 2, 21.

Figure 9:
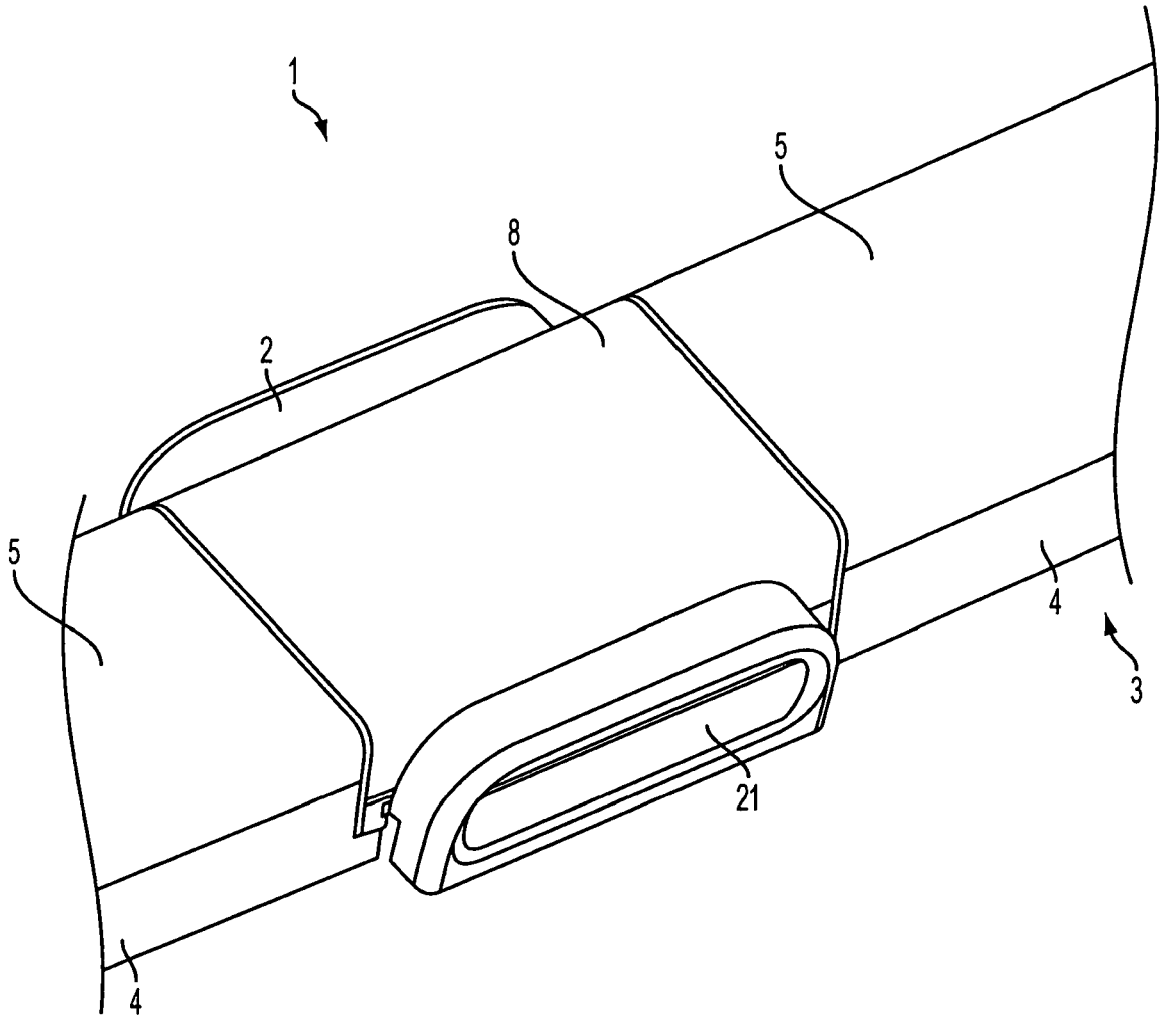
FIG. 9 shows a third embodiment of a locking handle with two slide actuators and two star handles.
Figure 10:
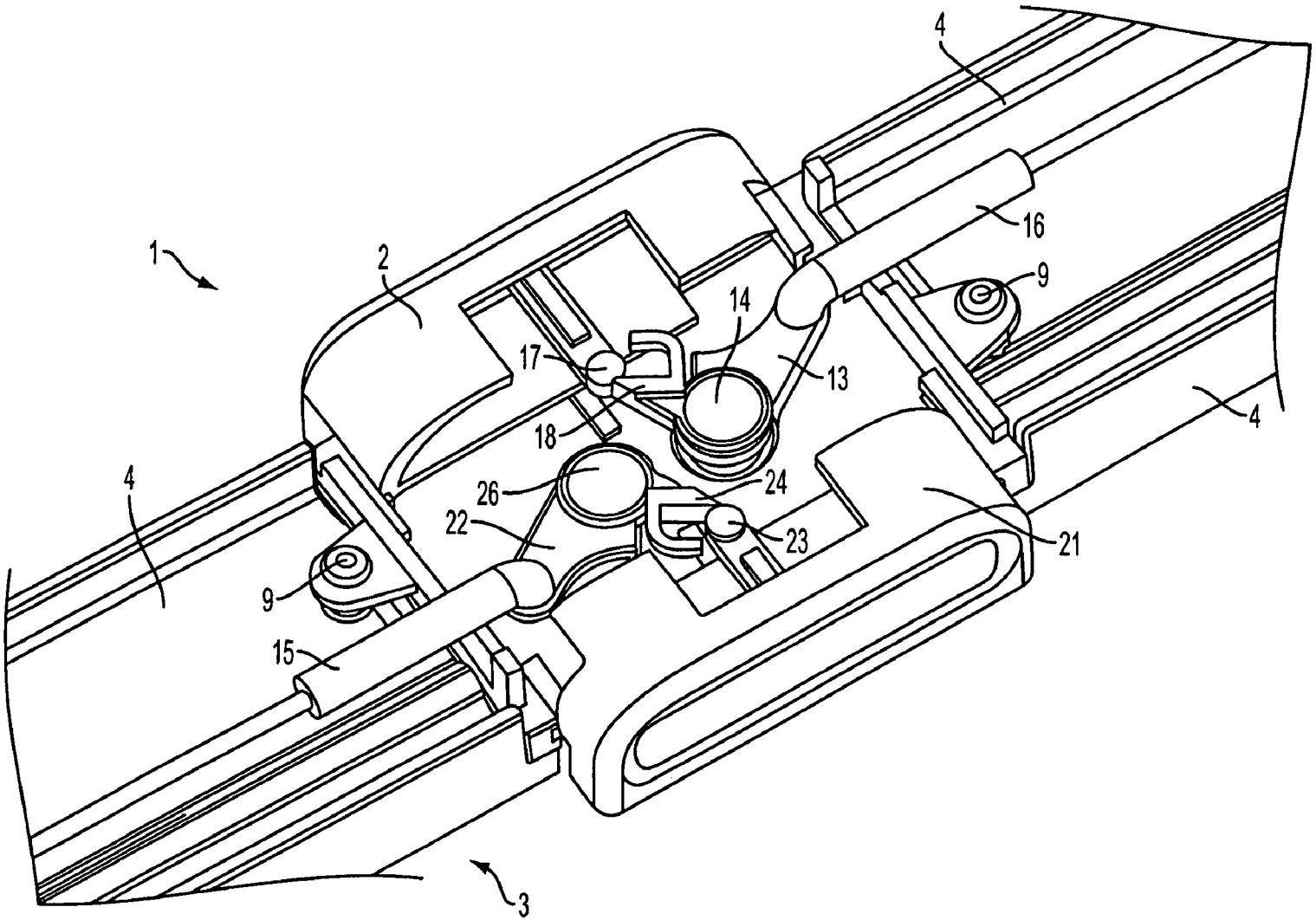
FIG. 10 shows the third embodiment of the locking handle in a representation corresponding to FIG. 9 without the panel of the locking handle and without the covers of the frame part.

In the third embodiment which is shown in FIGS. 9 and 10, the coinciding components are again provided with the same reference numerals. In contrast to the second embodiment, the further star handle is here rotatably supported around a further axle 26 which is spaced apart from the axle 14 for the star handle 13. The axles 14, 26 are spaced apart from one another in the longitudinal direction of the frame part 3.

In all the embodiments, the frame part 3 in which the respective sliding handle is provided is a vertically extending part of the frame of a sliding window which extends in the vertical direction and which can be displaced in the horizontal longitudinal direction of the vehicle. Accordingly, the slide actuators 2, 21 are likewise displaceably supported in the horizontal longitudinal direction of the vehicle. The locking handles of the embodiments shown are accordingly actuable in the direction of displacement of the sliding window.

Figure 11:
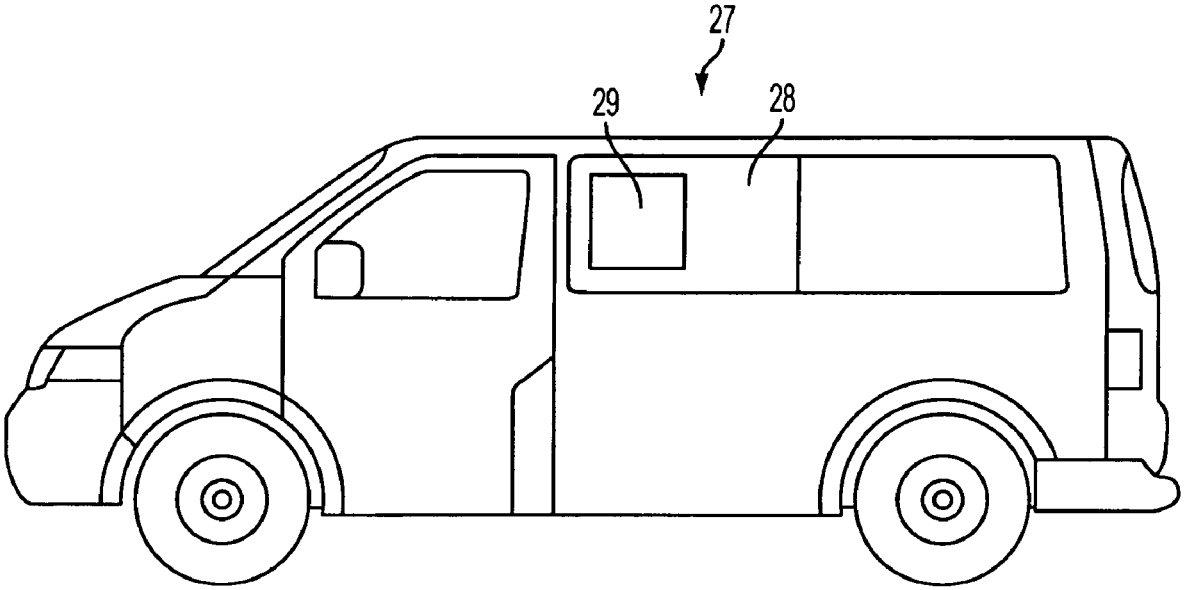
FIG. 11 shows a vehicle in a side view.
Figure 12:
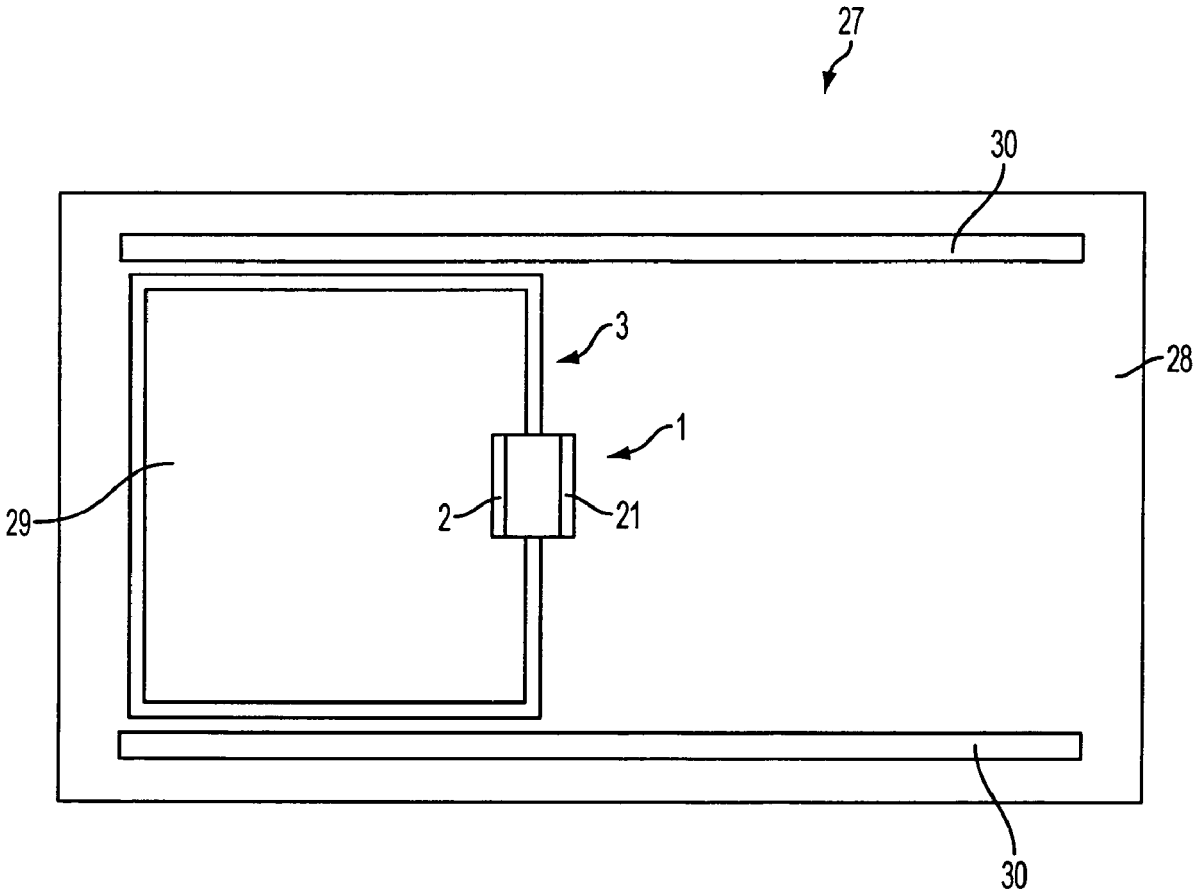
FIG. 12 shows a sliding window of a motor vehicle in a side view.
Figure 13:
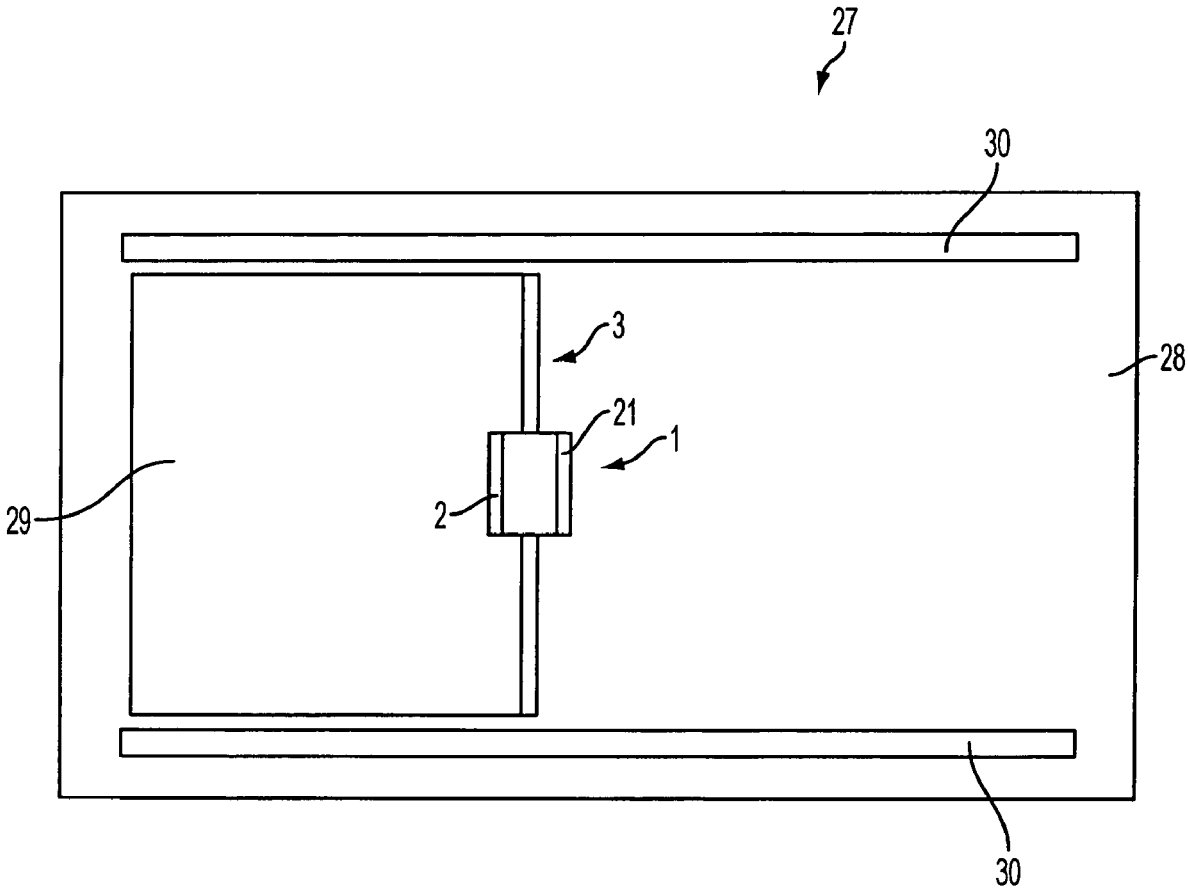
FIG. 13 shows a modification of the sliding window of FIG. 12.

A vehicle is shown in a side view in FIG. 11. The side window 27 comprises a fixed window 28 which is connected, in particular adhesively bonded, to the body of the motor vehicle and a sliding window 29 which is displaceable in the longitudinal direction of the motor vehicle. The guide rails 30, which are shown in FIGS. 12 and 13 and are provided at the fixed window 28, serve this purpose. The guide rails 30 are preferably adhesively bonded to the fixed window 28. They extend parallel to one another and spaced apart from one another in the longitudinal direction of the vehicle.

In the embodiment shown in FIG. 12, the sliding window 29 has a peripheral frame which covers all four sides of the rectangular sliding window 29. A locking handle 1 is provided at the vertically extending frame part 3. The sliding window 29 is displaceable in the horizontal longitudinal direction of the vehicle. Accordingly, the slide actuators 2, 21 of the latching handle 1 are likewise displaceably supported in the horizontal longitudinal direction of the vehicle.

In the embodiment of FIG. 13, a frame part is only present at one side of the sliding window 29, namely the vertically extending frame part 3 at which the locking handle 1 is provided.

A locking handle is provided by the present disclosure which is in particular suitable for sliding windows of vehicles or of motor vehicles. The actuation takes place by a pressure actuation. The actuation direction of the locking handle is preferably the same as the displacement direction of the sliding window. The advantage can hereby be achieved that the force applied for the actuation of the handle can be utilized for the opening or closing of the moving window.

The invention claimed is:

1. A sliding window for a motor vehicle comprising:

a frame part composed of a base and a cover portion, a locking handle located between the cover portion and the base and comprising a cam having a plurality of sides that form a plurality of points which is rotatably supported around an axle and to which one or more locking rods are fastened, a slide actuator comprising an actuator part having a gripping region positioned proximate an edge of the locking handle, a pair of walls extending perpendicularly to the sliding movement of the slide actuator, and an engagement part provided at the cam, the slide actuator being biased such that the gripping region is positioned outward from the cam and displaceable towards the cam to cause rotation of the cam such that the one or more locking rods move longitudinally toward the cam, and a pair of guide rails extending perpendicularly from the base on which the pair of walls of the slide actuator are positioned against in order to allow the slide actuator to be displaceable, the pair of guide rails being positioned on opposite sides of the cam such that the cam is positioned between each of the pair of guide rails, and wherein the slide actuator is actuatable in the direction of displacement of the sliding motor vehicle window.

2. The sliding window according to claim 1, further comprising a compression spring supported at the slide actuator to bias the gripping region away from the cam.

3. The sliding window according to claim 1, wherein the slide actuator is covered by a panel.

4. The sliding window according to claim 1, wherein two locking rods are fastened to the cam.

5. The sliding window according to claim 4, wherein the two locking rods are fastened to oppositely disposed sides of the axle of the cam.

6. The locking handle according to claim 1, comprising a further locking handle, operatively connected to the other locking handle, and comprising an additional slide actuator and an additional cam to which one or more of the locking rod are fastened.

7. The locking handle according to claim 6, wherein the slide actuators are guided longitudinally displaceably in opposite directions.

8. The locking handle according to claim 7, comprising a compression spring supported at both slide actuators.

9. The locking handle according to claim 6, wherein the cam of the further locking handle is rotatably supported around the same axle as the other cam.

10. The locking handle according to claim 6, wherein the cam of the further locking handle is rotatably supported around a further axle which is spaced apart from the axle of the other cam.

11. The sliding window according to claim 1, wherein the locking handle is provided in a frame part of the sliding window.

12. The sliding window according to claim 11, wherein the slide actuator of the locking handle is longitudinally displaceably guided in a direction transverse to the longitudinal direction of the frame part.

13. A locking handle for a sliding motor vehicle window that has a frame part that is composed of a cover portion and a base, comprising:

a rotatable member rotatably supported about an axle;

a locking rod having an end operatively engaged with the rotatable member, such that rotation of the rotatable member about the axle causes a generally longitudinal movement of the locking rod; and a slide actuator operatively engaged with the rotatable member so that displacement of the slide actuator in an actuating direction imparts rotation to the rotatable member, thereby producing the generally longitudinal movement of the locking rod, the slide actuator having a gripping region positioned proximate an edge of the locking handle and a pair of walls extending perpendicularly to the displacement direction of the slide actuator, the slide actuator being biased such that the gripping region is positioned outward from the rotatable member and displaceable towards the rotatable member; and a pair of guide rails on which the pair of walls of the slide actuator are positioned against in order to allow the slide actuator to be displaceable, the pair of guide rails being positioned on opposite sides of the rotatable member such that the rotatable member is positioned between each of the pair of guide rails, where the actuating direction is in an opening direction of the sliding motor vehicle window.

14. The locking handle of claim 13, further comprising a spring supported at the slide actuator and configured to bias the slide actuator away from the actuating direction.

15. The locking handle of claim 13, further comprising a second rotatable member and a second locking rod having an end operatively engaged with the second rotatable member, such that rotation of the second rotatable member causes a generally longitudinal movement of the second locking rod.

16. The locking handle of claim 13, where the second rotatable member is supported about the same axle as the rotatable member.

17. The locking handle of claim 13, where the second rotatable member is supported about a second axle which is spaced apart from the axle supporting the rotatable member.

* * * * *